US007046950B2

(12) United States Patent
Fuma et al.

(10) Patent No.: US 7,046,950 B2
(45) Date of Patent: May 16, 2006

(54) IMAGE FORMING APPARATUS

(75) Inventors: Hiroshi Fuma, Yamanashi (JP); Haruo Iwahashi, Aichi (JP); Hisayoshi Nagase, Hachioji (JP); Masahiro Onodera, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 10/795,272

(22) Filed: Mar. 9, 2004

(65) Prior Publication Data

US 2004/0179876 A1 Sep. 16, 2004

(30) Foreign Application Priority Data

Mar. 13, 2003 (JP) ..... 2003-067405

(51) Int. Cl.
*G03G 15/20* (2006.01)

(52) U.S. Cl. ..... 399/329; 399/328; 219/216

(58) Field of Classification Search ..... 399/328–329; 219/469–471, 216

See application file for complete search history.

(56) References Cited

U.S. PATENT DOCUMENTS

| | | | | |
|---|---|---|---|---|
| 4,640,600 | A * | 2/1987 | Hirabayashi et al. | 399/324 |
| 4,910,559 | A * | 3/1990 | Kuge et al. | 399/331 |
| 5,847,361 | A * | 12/1998 | Yonekawa et al. | 219/216 |
| 6,144,832 | A * | 11/2000 | Nimura et al. | 399/328 |
| 2004/0240913 | A1 * | 12/2004 | Tomatsu | 399/328 |

* cited by examiner

*Primary Examiner*—Christopher W. Fulton
*Assistant Examiner*—Tania Courson
(74) *Attorney, Agent, or Firm*—Finnegan, Henderson, Farabow, Garrett & Dunner, L.L.P.

(57) ABSTRACT

An embodiment of the invention includes a fixing device of an image forming apparatus. The fixing device may include a first pressure applying roller, a second pressure applying roller which is pressed onto the first pressure applying roller, and a fixing belt which is entrained about the first pressure applying roller and is pressed onto the first pressure applying roller by the second pressure applying roller. When a transfer material carrying an unfixed image is inserted between the second pressure applying roller and the fixing belt, the unfixed image may be brought into contact with the fixing belt so that the unfixed image is heated and fixed on the transfer material. A frictional coefficient between the fixing belt and the first pressure applying roller may be set to be less than a frictional coefficient between the fixing belt and the transfer material.

4 Claims, 4 Drawing Sheets

IMAGE FORMING APPARATUS

BACKGROUND OF THE INVENTION

The present invention relates to an image forming apparatus such as a copying machine, a facsimile, and a printer, each having therein a fixing device which employs a belt.

In prior art of fixing devices which are publicly known and generalized, employed are an endless belt maintained in a predetermined temperature range, or paired pressure applying rollers with the endless belt sandwiched in between, and therefore, a transfer material supporting thereon unfixed toner images faces the surface of the endless belt, and is conveyed and pressed onto the endless belt by the paired pressure applying rollers, and thereby, the toner particles making up images on the transfer material are heated and fixed.

However, in fixing devices which employ such an endless belt, the rollers are often deformed by heat, and the driving resistance factor of tension is very large in the nipping area (an area in which the transfer material is nipped by the belt and the pressure applying roller), and is also a very large factor on the belt supporting roller (which is a heating roller), therefore, a change of torque occurs on the belt driving roller which is the fixing roller, and also on the pressure applying roller which presses the transfer material onto the fixing roller, and then, slippage may occur between the paired pressure applying rollers and the belt, resulting in a slippage of the images on the transfer material and the belt.

In order to avoid the matter mentioned above, disclosed are several technologies, one of which is that the pressure applying roller and the heating roller are simultaneously driven by a driving source through gears (see patent document 1), and another technology is that the torque of either the separating roller or the fixing roller is controlled and when the torque is increased to a predetermined value, driving power is activated for the other roller, and as a result, the belt is tensioned not more than necessary, causing the belt to run stably (see patent document 2).

[Patent Document 1] Tokkai 2001-125422

[Patent Document 2] Tokkai 2002-251095

SUMMARY OF THE INVENTION

The objective of the present invention is to provide an image forming apparatus employing a fixing device, wherein the slippage of the images is reduced as much as possible, which is caused by a very small speed difference generated between the paired pressure applying rollers referred to in the above-mentioned drawback, the manufacturing accuracy of the roller, and the deterioration with age of the elastic layer of the roller with age, and wherein the stable images can be achieved.

The above-described objective is attained by the following structures.

Structure 1.

A image forming apparatus having a fixing device to heat and fix unfixed images generated on a transfer material, in which the fixing device includes:

a belt which comes into contact with the unfixed images for heating, pressing, and fixing;

paired pressure applying rollers installed with a belt sandwiched between them, for nipping, pressing, and conveying the belt and the transfer material;

wherein driving power but not through the belt is provided for each roller of the paired pressure applying rollers.

Structure 2.

An image forming apparatus having a fixing device to heat and fix unfixed images generated on a transfer material, in which the fixing device includes:

a belt which comes into contact with the unfixed images for heating, pressing, and fixing;

paired pressure applying rollers with an endless belt sandwiched in between, for nipping, pressing, and conveying the belt and the transfer material;

wherein a frictional coefficient between the belt and a first pressure applying roller, which is one of the paired pressure applying rollers and is installed in the interior of the belt loop, is set to be less than the frictional coefficient between the belt and the transfer material.

Structure 3.

The image forming apparatus in structure 2, the frictional coefficient between the belt and a second pressure applying roller, which is one of the paired pressure applying rollers and is installed on the exterior of the belt loop, is set to be less than the frictional coefficient between the belt and the transfer material.

Structure 4.

An image forming apparatus having a fixing device to heat and fix unfixed images generated on a transfer material, in which the fixing device includes:

a belt which comes into contact with the unfixed images for heating, pressing, and fixing;

paired pressure applying rollers with the endless belt sandwiched in between, for nipping, pressing, and conveying the belt and the transfer material;

wherein the surface of a first pressure applying roller, which is one of the paired pressure applying rollers and is installed in the interior of the belt loop, is coated by a fluororesin.

DETAILED DESCRIPTION OF THE PREFERRED EMBODIMENT

Firstly, the image forming apparatus of the present invention will now be explained.

In the explanation of the embodiment of the present invention, the technical scope of the present invention is not limited by the terms used in the present specification.

Figure 1:
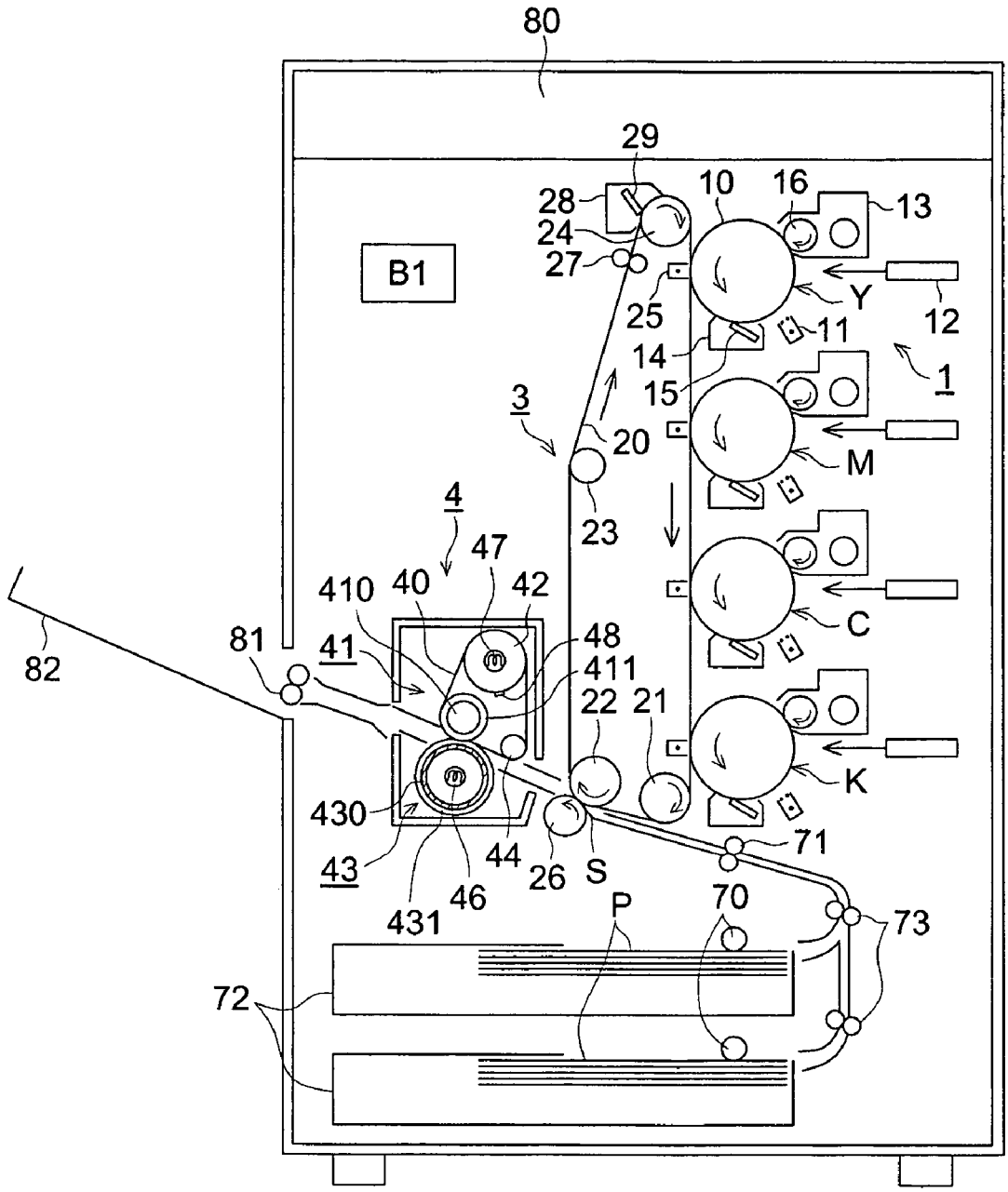
FIG. 1 is a schematic diagram showing an example of the total structure of the image forming apparatus.

FIG. 1 is a schematic diagram showing an example of the total structure of the image forming apparatus.

In the following description, the identical number corresponds to the same item in each drawing.

In FIG. 1, numeral 10 is a photoconductor, on the periphery of a cylindrical metallic base on which is formed a photoconductive layer and a photosensitive layer such as an a-Si layer, and as an organic photoconductor (OPC), and photoconductor 10 rotates counter clockwise as shown by the allow in the figures, under the condition that the conductive layer is grounded.

Numeral 11 shows a scorotoron charger as a charging means, numeral 12 shows a writing device as an image writing means, numeral 13 shows a developing device as a developing means, and each of numerals 11, 12, and 13 is arranged around photoconductor 10, at a predetermined distance. Provided also is cylindrical developing sleeve 16, formed of a nonmagnetic stainless steel or aluminum, and developing sleeve 16 rotates in the same direction as photoconductor 10 due to contact with photoconductor 10. Numeral 14 shows a cleaning device to clean the surface of photoconductor 10, while numeral 15 shows a cleaning blade. Image forming means 1 is composed of photoconductor 10, scorotoron charger 11, developing device 13, and cleaning device 14. Since image forming means 1 for each of several colors have the same mechanical structures, the numerals are assigned to Y (yellow) group in the figure, and are omitted for M (magenta), C (cyan), and K (black).

Numeral 20 shows an intermediate transfer roller, which is trained about driving roller 21, grounding roller 22, tensioning roller 23, antistatic roller 27, and driven roller 24. Belt unit 3 is composed of not only the above-mentioned rollers, but also intermediate transfer belt 20, transfer device 25, and cleaning device 28.

Intermediate transfer belt 20 is driven by the rotation of driving roller 21 which is driven by an unillustrated motor.

Image forming means 1 of each color are arranged in the order of Y, M, C, and K, in the driven direction of intermediate transfer belt 20. Photoconductors 10 of Y, M, C, and K come into contact with the surface of intermediate transfer belt 20. At their respective contact points, photoconductors 10 of Y, M, C, and K rotate in the same direction and at the same line speed as those of intermediate transfer belt 20.

Electric signals corresponding to the image data coming from reading device 80 are transformed to optical signals by an image forming laser, and then the optical signals are directed onto photoconductor 10 by writing device 12.

Intermediate transfer belt 20 is an endless belt at a volume resistivity of $10^6$–$10^{12}$ Ωcm, which is a seamless belt structured of two layers.

That is, a fluorine coating at a thickness of 5–50 μm as a toner filming preventing layer is laid on a semi-conductive film base at a thickness of 0.1–1.0 mm, which is an engineered plastic such as a denaturated polyimide, a thermosetting polyimide, an ethylene tetrafluoro ethylene copolymer, a polyfluoro vinylidene, and a nylon alloy, on which a conductive material is randomly scattered.

As the base of the belt, it is further possible to use a semi-conductive rubber belt at a thickness of 0.5–2.0 mm, which is a belt made of a silicone rubber or a urethane rubber on which the conductive material is randomly scattered.

Numeral 25 shows a transfer device, applied to which is a directional voltage of the polarity opposite of the toner voltage, and which functions to transfer the toner images formed on photoconductor 10 onto intermediate transfer belt 20. As transfer device 25, it is possible to use a transfer roller, instead of a corona discharger.

Numeral 26 shows a transfer roller which is able to come into contact with or to be released from grounded roller 22, and which again transfers the toner images formed on intermediate transfer belt 20 onto transfer material P.

Numeral 28 is a cleaning device, which faces driven roller 24, with intermediate transfer belt 20 sandwiched between them. After the toner images are transferred onto transfer material P, the electric charge of the remaining toner particles on intermediate transfer roller 20 is reduced by antistatic roller 27, to which an alternate voltage is applied, superimposed on which is a direct current voltage of the same polarity as the toner or the opposite polarity to the toner, and further, the toner remaining on the surface of intermediate transfer belt 20 is cleaned by cleaning blade 29.

Numeral 4 shows a fixing device, which includes: fixing belt 40; first pressure applying roller (hereinafter referred to as the interior pressure applying roller) 41; second pressure applying roller (hereinafter referred to as the exterior pressure applying roller) 43; belt trained heating roller (hereinafter referred to as the heating roller) 42; auxiliary roller 44; halogen heaters 46, and 47; and a web (which is not illustrated) for cleaning the belt; wherein fixing belt 40, which is formed by a metallic base and, on which a silicon rubber is sandwiched and turned by the paired pressure applying rollers, being interior pressure applying roller 41 and exterior pressure applying roller 43.

Numeral 70 shows a sheet feeding roller, numeral 71 shows a timing roller, numeral 72 shows a sheet cassette, and numeral 73 shows a sheet conveyance roller.

Numeral 81 shows a sheet ejecting roller which conveys fixed transfer material P to sheet ejection tray 82.

Next, the fixing device relating to the present invention will be explained.

Figure 2:
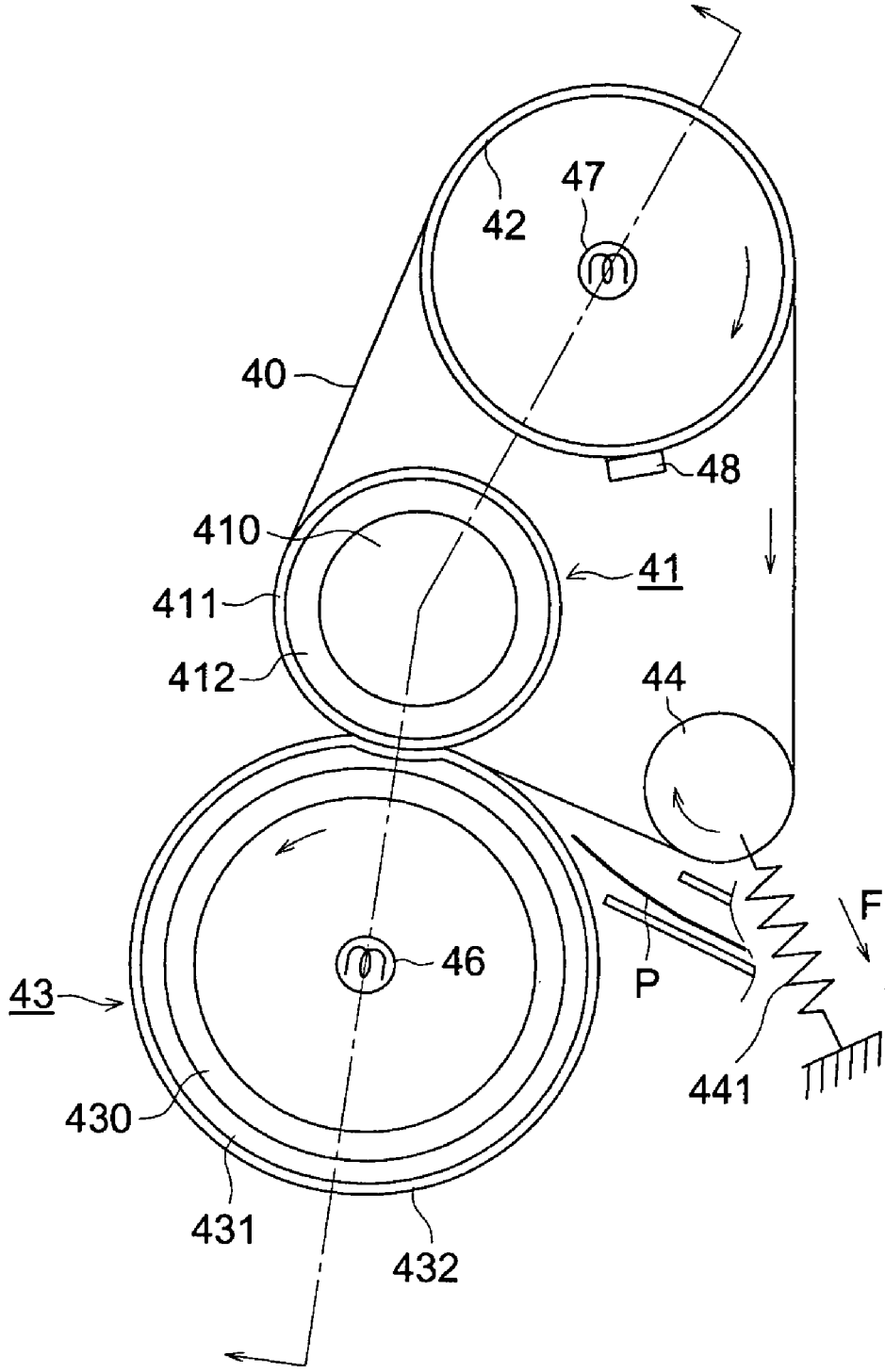
FIG. 2 is an enlarged view of a section of a fixing device of the first embodiment.

FIG. 2 is an enlarged view of the section of the fixing device of the first embodiment.

In FIG. 2, interior pressure applying roller 41 is formed in such a way that silicon rubber elastic layer 412 is formed on the surface of iron cored bar 410, and fluorine resin coated layer 411 is coated on elastic layer 412. Heating roller 42 is a cylinder formed of a thin aluminum, in which halogen heater 47 is installed for heating up the cylinder to a predetermined temperature. Fixing belt 40 entrained about heating roller 42 is heated by the conductive heat emitted from halogen heater 47. The temperature is measured by contact type thermo sensor 48 which is attached to heating roller 42, and is controlled by control section B1 (see FIG. 1).

Further, exterior pressure applying roller 43 is formed in such a way that silicon elastic layer 431 is baked onto cylindrical cored bar 430 which is formed of aluminum, and fluorine resin layer 432 is turned on elastic layer 431. Exterior pressure applying roller 43 is heated from its interior by halogen heater 46, and rotates counter clockwise.

Figure 3:
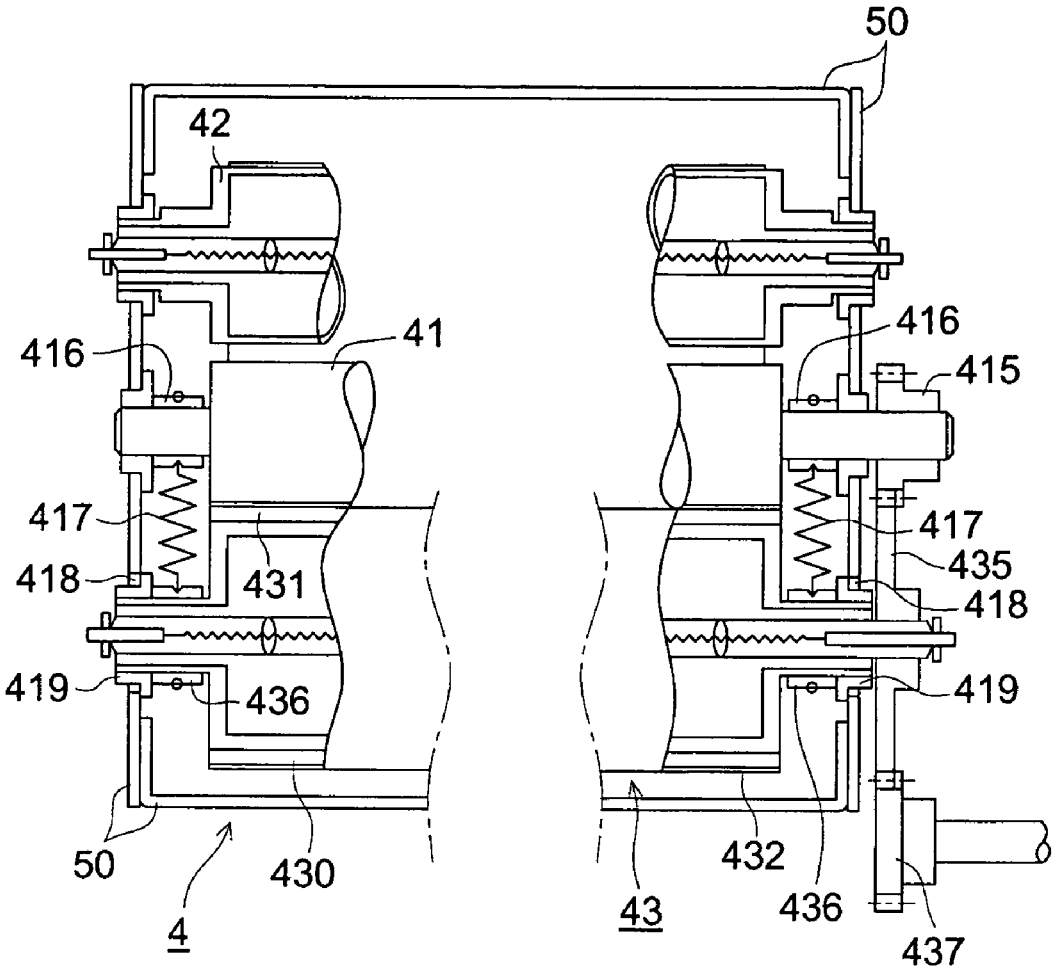
FIG. 3 is a drawing for explaining the drive train of the driving section of the fixing device of the first embodiment.

FIG. 3 is a drawing for explaining a power transmission of a driving section of the fixing device of the first embodiment.

In FIG. 3, interior pressure applying roller 41 and heating roller 42 are supported by the bearings on frame 50. Exterior pressure applying roller 43 is supported by bearing 419 which is movable in guide groove 418 on frame 50.

Exterior pressure applying roller 43 is always in contact with interior pressure applying roller 41 at a predetermined pressure by pressure applying springs 417 mounted on collars 416 and 436. It is also possible to employ a mechanism wherein exterior pressure applying roller 43 is mounted on a separate member, and exterior pressure applying roller 43 presses interior pressure applying roller 41 only when transfer material P is fixed.

Gear 415 is integral to interior pressure applying roller 41, and gear 435 is united with exterior pressure applying roller 43, gears 415 and 435 are geared together, and gear 435 is powered by a motor, which is not illustrated, through gear 437. Concerning the external diameters of exterior roller 41 and interior roller 43, and the number of teeth of gear 415 and gear 435, the diameters and the number of teeth are determined so that the line speeds of both rollers are equal on the section where both rollers come into contact with each other. Heating roller 42 is driven by fixing belt 40 and in turn heats fixing belt 40.

Auxiliary roller 44 is supported by bearings, which are not illustrated, and is movable in allowed direction F (see FIG. 2) in a guide groove by spring 441. Therefore fixing belt 40 is slightly entrained about pressure applying external roller 43, in order to increase the area on which the fixing belt comes into contact with exterior roller 43.

In the above-mentioned mechanism of the power transmission, if the rotation ratio of each roller in an actual pressing work is determined by the external diameters only, slippage happens in the nip area (the contact area between the rollers) due to the deformation of elastic layer 431. Therefore, the rotation ratio must be determined using the following procedure. Firstly, one of the rollers is rotated under the pressed condition, and the rotation ratio is determined by the number of rotation of each roller, and then the gear ratio is determined so that minimal slippage is generated, however, if any slippage is still generated using the above procedure, the external diameter of one of the rollers must be precisely adjusted so that any velocity differential is cancelled in the nipped area.

The driving power is transferred from the power source to both rollers 41 and 43 through gears 437, 435 and 415. That is, the power is transmitted to transfer material P through the route of "pressure applying external roller 43—interior pressure applying roller 41—fixing belt 40—transfer material P", whereby peripheral velocity differential between fixing belt 40 and exterior pressure applying roller 43 is cancelled.

Granting that the belt is driven by the driving power of one of the rollers, the driving power is transferred through the route of "interior pressure applying roller 41—fixing belt 40—transfer material P—pressure applying external roller 43", (or its reverse route), and thereby the power being transferred on each transfer area becomes greater toward the upstream side of the transferring route. Comparing the above case to the case that the driving power is activated onto both interior pressure applying roller 41 and the exterior roller 43, the driving power becomes excessive so that drawbacks happen such as slippage of the images due to the slippage of the rollers and the belt, stretching or waviness of transfer material P due to the velocity change in the course of image transfer or sheet ejection. Accordingly, the use of driven rollers prevents such drawbacks.

However, even though most of the velocity differential is cancelled as mentioned above, a very small velocity differential is still generated by the limitation of the mechanical manufacturing accuracy or the change due to the elastic layer over a time interval, which results in image slippage. To counter this effect, friction coefficient $\mu 1$ between fixing belt 40 and interior pressure applying roller 41 is set to be smaller than a friction coefficient between the surface of fixing belt 40 and transfer material P.

Specifically, fluorine resin layer 411 of a low friction coefficient is mounted on the periphery of elastic layer 412 (which is a low hardness rubber) of interior pressure applying roller 41, and thereby, friction coefficient $\mu 1$ between fixing belt 40 and interior pressure applying roller 41 becomes less than friction coefficient $\mu 2$ between the surface of fixing belt 40 and transfer material P. Therefore, even when a velocity differential is generated in spite of these effects, slippage does not occur between transfer material P and fixing belt 40 (which is the belt surface carrying the images), and any slippage occurs between interior pressure applying roller 41 and fixing belt 40, by which the drawback of image slippage is prevented.

Further, even when $\mu 1$ is greater than $\mu 2$ due to the stain, friction coefficient $\mu 3$, which is the friction coefficient between exterior pressure applying roller 43 and transfer material P, is set to be less than $\mu 2$, and thereby the slippage occurs firstly between exterior pressure applying roller 43 and transfer material P, which results in the accurate and reliable transfer. By employing a fluorine resin layer for the surfaces of interior pressure applying roller 41 and exterior pressure applying roller, it is possible to make friction coefficients $\mu 1$ and $\mu 3$ to be less than friction coefficient $\mu 2$ which is between transfer material P and fixing belt 40. Standard values for the friction coefficients are $\mu 1=0.1$, $\mu 2=0.15–0.3$, and $\mu 3=0.15–0.2$. It must be noted that friction coefficients $\mu 2$ and $\mu 3$ depend upon the type of transfer material P. Further, it is possible to increase the smoothness of the surface of the exterior pressure applying roller than that of the fixing belt, or to employ the fluorine resin exhibiting low friction resistance.

In the structure in which the surface of interior pressure applying roller is formed by only elastic layer 412, made of a rather soft rubber, though the nip area increases, the surface of interior pressure applying roller 41 becomes sticky. In this case, the slippage between interior pressure applying roller 41 and fixing belt 40 is reduced, and it is not possible to cancel the distortion generated by the deflection of interior pressure applying roller 41, resulting in irradiating sounds, creases on the belt, and occasionally a cut belt. However, such problems can be overcome by employing fluorine resin layer 412 exhibiting low friction resistance, making it very slippery.

Figure 4:
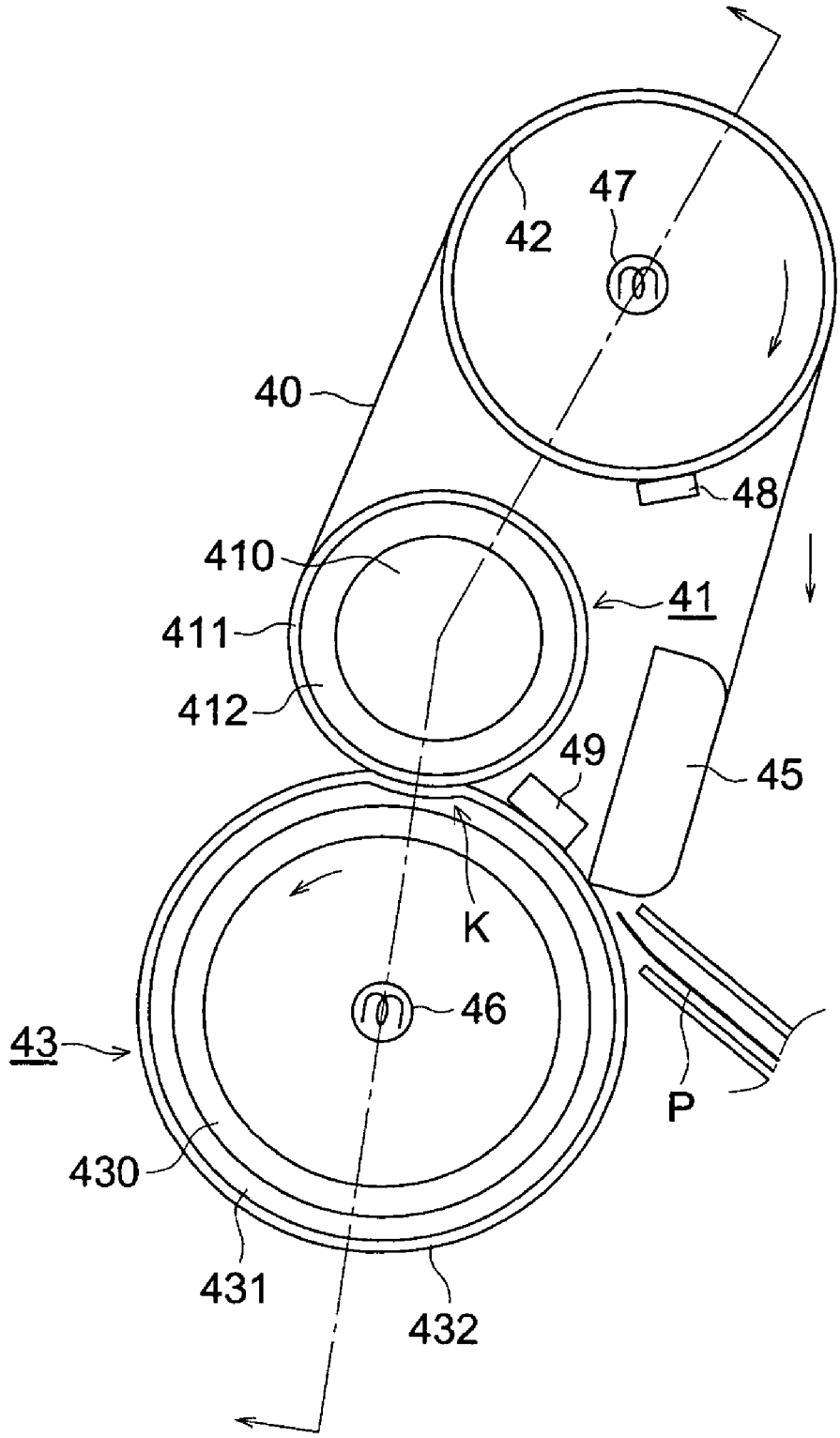
FIG. 4 is an enlarged view of the section of the fixing device of the second embodiment.

FIG. 4 is shows the power transmission sequence of the driving section of the fixing device of the second embodiment.

In FIG. 4, numeral 45 shows a tensioning member for fixing belt 40, numeral 49 shows a pressure applying pad to increase a fixing intensity which serves to obtain a higher luster by strongly pressing fixing belt 40 onto exterior pressure applying roller 43 and thereby increasing the nip area.

Before transfer material P enters primary nip area K, which is activated by interior pressure applying roller 41 and exterior roller 43, transfer material P is nipped and pressed between exterior pressure applying roller 43 and fixing belt 40, is then pre-heated by heat of fixing belt 40, and pressed by pressure applying pad 49. After that, in primary nip area K, toner is fixed onto transfer material P by the heat of fixing belt 40 and by the pressure of interior pressure applying roller 41 and exterior roller 43. The elastic layer comes into direct contact with the toner layer, or indirectly through a very thin release agent layer, and thereby the elastic layer is partially changed in thickness, based on the transfer material and the copying concavity and convexity of toner, resulting in the uniform contact and uniform fixing, without producing an uneven luster. The toner images thus acquires an adequate luster. After the fixing process, transfer material P stably separates from fixing belt 40.

As explained above, though the fixing device is composed of a large number of the mechanical members such as a belt, a heating roller, a tension member of the belt, and a pressing pad, the present invention effectively prevents slippages of the image, by using the frictional relationship between the pressure applying rollers and the belt, which is the same as in the case of the first embodiment.

Further, the present invention is very effective for a color image forming apparatus, because in a color image forming apparatus, the ratio of the image covered by toner (this ratio is the photographic density in the case of a monochromatic image forming apparatus) is very high, and the frictional resistance between the transfer material and the fixing belt is apt to be excessively low due to toner lying between them, and the image slippage is very visible.

As effects of the present invention, it is possible to cancel slippage of the transfer material and also to prevent image slippage, because the friction coefficient between the fixing belt and the pressure applying interior belt is set to be less than that between the fixing belt and the transfer material.

What is claimed is:

1. A fixing device of an image forming apparatus, comprising:

a first pressure applying roller;

a second pressure applying roller which is pressed onto the first pressure applying roller; and a fixing belt which is entrained about the first pressure applying roller and is pressed onto the first pressure applying roller by the second pressure applying roller;

wherein when a transfer material carrying an unfixed image is inserted between the second pressure applying roller and the fixing belt, the unfixed image is brought into contact with the fixing belt so that the unfixed image is heated and fixed on the transfer material; and wherein a frictional coefficient between the fixing belt and the first pressure applying roller is set to be less than a frictional coefficient between the fixing belt and the transfer material.

2. The fixing device of the image forming apparatus in claim 1, wherein a frictional coefficient between the belt and the second pressure applying roller is set to be less than a frictional coefficient between the fixing belt and the transfer material.

3. The fixing device of the image forming apparatus in claim 1, wherein a surface of the first pressure applying roller is covered by a flourine resin coated layer.

4. The fixing device of the image forming apparatus in claim 1, wherein a driving power from a driving source is transferred to both the first pressure applying roller and the second pressure applying roller.

* * * * *